United States Patent [19]

Johnson

[11] Patent Number: 4,967,420

[45] Date of Patent: Nov. 6, 1990

[54] TUNNEL COLLAR SHIRT

[76] Inventor: Horace W. Johnson, P.O. Box 1953, Cleveland, Ohio 44106

[21] Appl. No.: 422,961

[22] Filed: Oct. 18, 1989

[51] Int. Cl.[5] ..... A41B 3/00; A41B 1/00

[52] U.S. Cl. ..... 2/116; 2/129; 2/139; 2/115; D2/602; D2/208

[58] Field of Search ..... 2/116, 129, 139, 115; D2/129, 602, 208

[56] References Cited

U.S. PATENT DOCUMENTS 3,068,486 12/1962 Gleeson ..... 2/129

3,434,160 3/1969 Toomey et al. ..... 2/129

*Primary Examiner*—Werner H. Schroeder

*Assistant Examiner*—Gloria Hale

*Attorney, Agent, or Firm*—Fay, Sharpe, Beall, Fagan, Minnich & McKee

[57] ABSTRACT

A shirt having an improved collar construction is provided. The shirt is constructed with a back shirt section joined to a back collar section. A "V" type material is attached at the joinder of these sections to re-enforce the attachment. A front shirt section is joined to a front collar section, the front and collar sections each having attached oppositely disposed half-flaps which are thereafter connected. The front and back shirt sections are then connected. Snaps, or another form of connector, are provided for holding the flaps on the inside of the collar, where at least a portion of the back collar section is covered.

9 Claims, 3 Drawing Sheets

FIG. 2
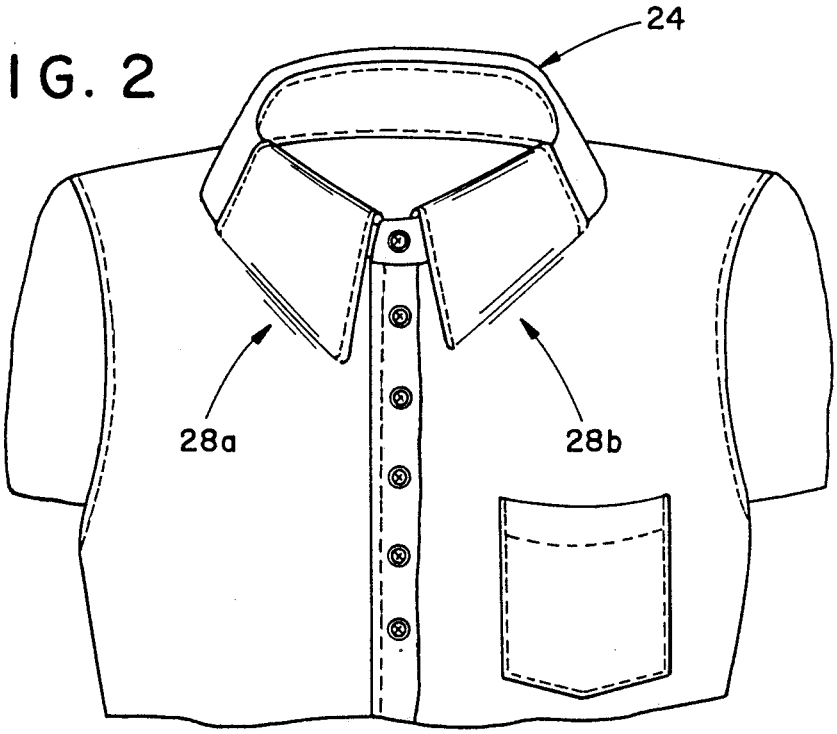
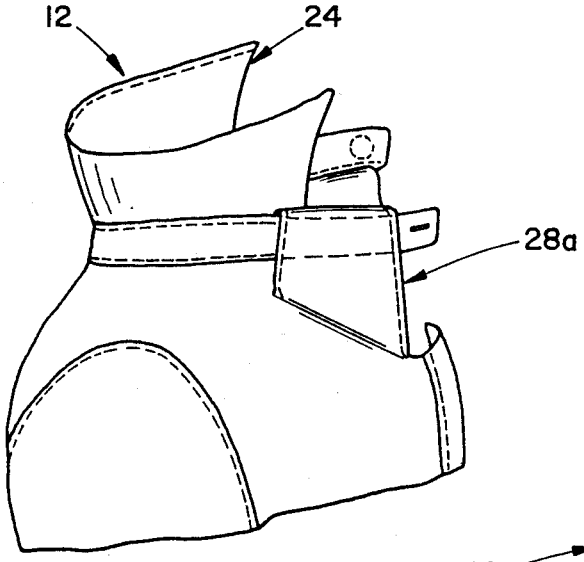
FIG. 3
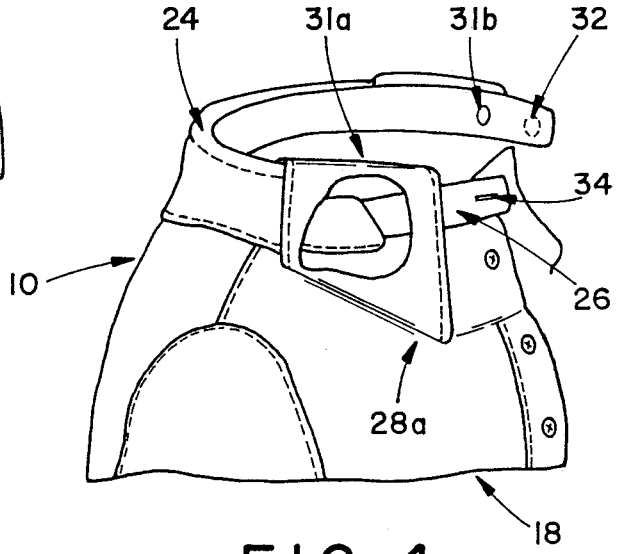
FIG. 4

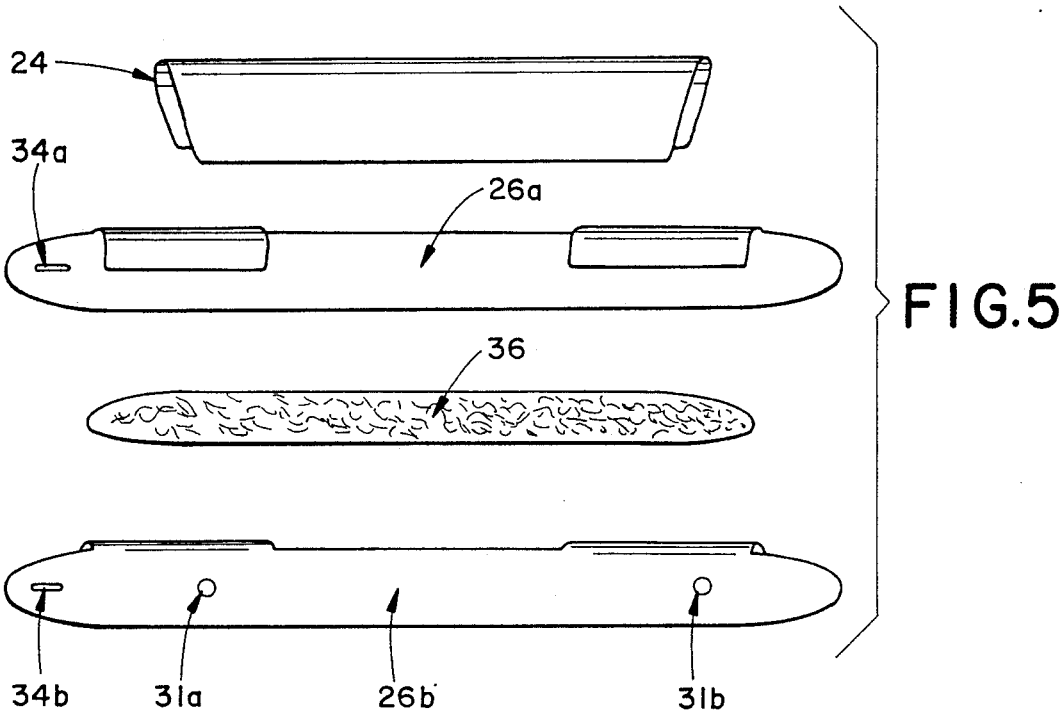
FIG.5
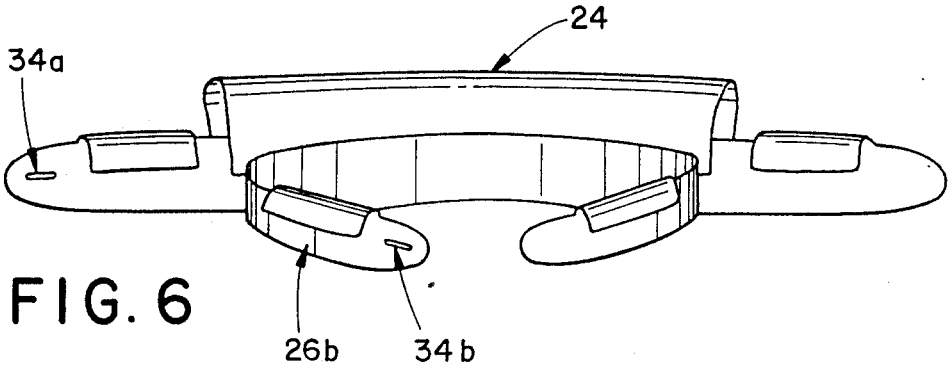
FIG. 6
FIG. 7
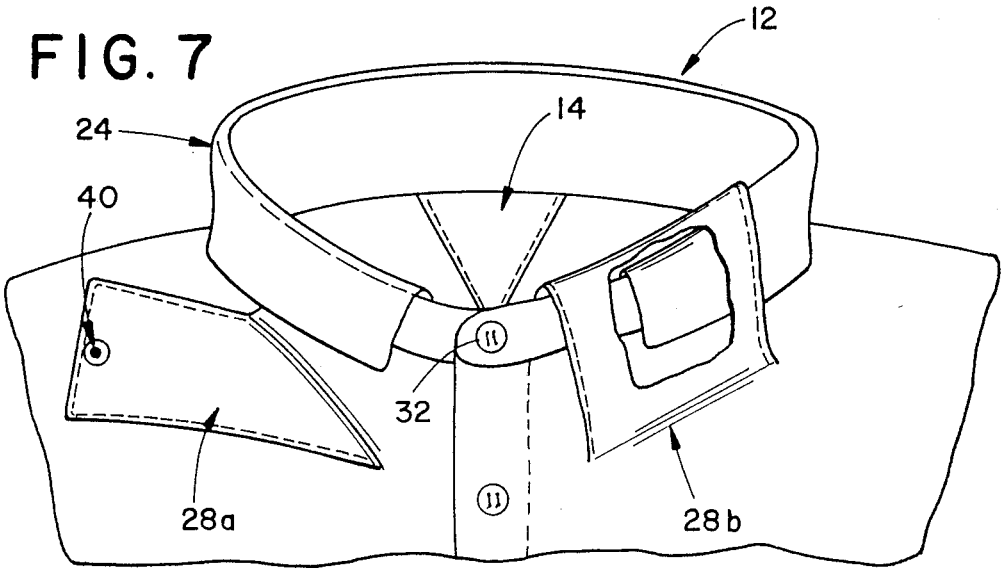

TUNNEL COLLAR SHIRT

BACKGROUND OF THE DISCLOSURE

The present invention relates to the production of articles of clothing and finds particular application in conjunction with the forming of shirt collars and will be described with reference thereto.

Conventionally, a shirt collar, after being attached to the shirt, is one continuous piece of fabric where the collar is attached at the shirt body's neck opening and went continuously around the neck from one flap or wing in the front of the shirt until reaching the other flap or wing located opposite the first flap or wing.

The collar, including a neck portion, and the flaps or wings are constructed to be turned downwardly with respect to a neck band along a formed line. An elongated semi-rigid element is disposed within the flaps or wings of the collar. The collar itself is constructed such that it exhibited rigid or stiff characteristics. The flaps or wings of the collar stay in place due to the semi-rigid composition of the collar and the semi-rigid element disposed within the flaps or wings.

The semi-rigid composition of the material allows the collar to be placed in an upwardly position for the placement of a tie or other such article around the collar, thereafter, the collar is folded downwardly to cover the tie or other such article which encircles the neck.

In collars of this type, no fastening of the flap section in the downward position is provided. The only reason the collar remains in the down position is due to the fold line in the upper collar section and the rigidity of the collar material. Due to this design feature, the flaps of the collar have a tendency to move and flip up upon encountering a force, such as a gust of wind. Additionally, after frequent washing or dry cleaning, such collars have a tendency to lose the aforementioned semi-rigidity, thereby allowing the collars to curl either inwardly or outwardly destroying the collar's function of concealing a garment, such as a tie, underneath the collar.

Various means have been employed to avoid the above-mentioned problems. One solution has been to produce an eyelet in the lower section of the collar's flap and introduce a button-holding arrangement in order to maintain the flap in a down position. Another means of dealing with the above-mentioned problems has been through the use of a tie tac where small holes are produced in each of the shirt's flaps and a rigid material is passed through the two holes, connecting the two holes and then securing the rigid material to maintain this interconnection.

Due to normal wear and tear, accompanied with the use of the shirt and the washing or dry cleaning of the shirt, the button-type arrangement as described above has a tendency to have the buttons become either lost or destroyed, thereby making the button-type arrangement non-functional. Additionally, after a certain amount of dry cleaning or washing, the eyelets used in the button-type arrangement tend to become distorted and, thereafter, do not maintain the button in a secure position. In a tie tac arrangement, the tie tac is a completely separate element from the shirt itself, damage to the tie tac or loss of the rigid material making up the tie tac causes this arrangement to become inoperative.

In accordance with the present invention, a shirt collar which is more reliable in maintaining its flaps in a downwardly position is provided.

SUMMARY OF THE INVENTION

In accordance with one aspect of the present invention, a shirt having an improved two-part collar construction is provided. The shirt is constructed having a back shirt section joined to a back collar section, with a "V" type material attached for reinforcing the joined collar and shirt sections. Further, a front shirt section is joined to a front collar section. The shirt and collar sections have half-flaps permanently connected. Oppositely aligned half-flaps are then joined to form two flaps, after which the front and back shirt sections can be connected. Snaps, or another form of connectors, are provided for holding the flaps on the inside of the collar, where at least a portion of the back collar section is covered.

One advantage of the present invention resides in the flaps' lower portion being integrally and permanently connected to the front collar section and the front shirt section. The preferred embodiment is able to maintain the flaps in a downward position even in adverse conditions, such as high gusts of wind.

Another advantage of the present invention is that it provides a reliable and nearly maintenance-free manner in which to maintain the flaps in a usable condition.

Yet another advantage of the present invention is to allow the fitting of articles of clothing, such as ties, in a more accurate manner. The present invention allows a neck tie to be tied and held in position by the back collar section alone. This makes for ease of retying the tie when mistakes have been made.

Still further advantages of the present invention become apparent to those of ordinary skill in the art upon reading and understanding a detailed description of the preferred embodiment.

BRIEF DESCRIPTION OF THE DRAWINGS

The invention may take form in certain parts and arrangement of parts, a preferred embodiment of which will be described in detail in this specification and illustrated in the accompanying drawings which form a part hereof and wherein:

FIG. 2 is a front illustrative view of the preferred embodiment of the present invention;

FIG. 3 is a side illustration with the back collar section in an upward position;

FIG. 4 is an illustrative cut-away showing the interaction between the back collar section in its downward position and the front collar section in its secured position;

FIG. 5 is an exploded view of the back collar section;

FIG. 6 is an illustrative drawing of a partially assembled back collar section;

FIG. 7 is an illustrative drawing of the two-part shirt collar's front flaps in an unsecured position and in a secured position.

DETAILED DESCRIPTION OF THE PREFERRED EMBODIMENT

Figure 1:
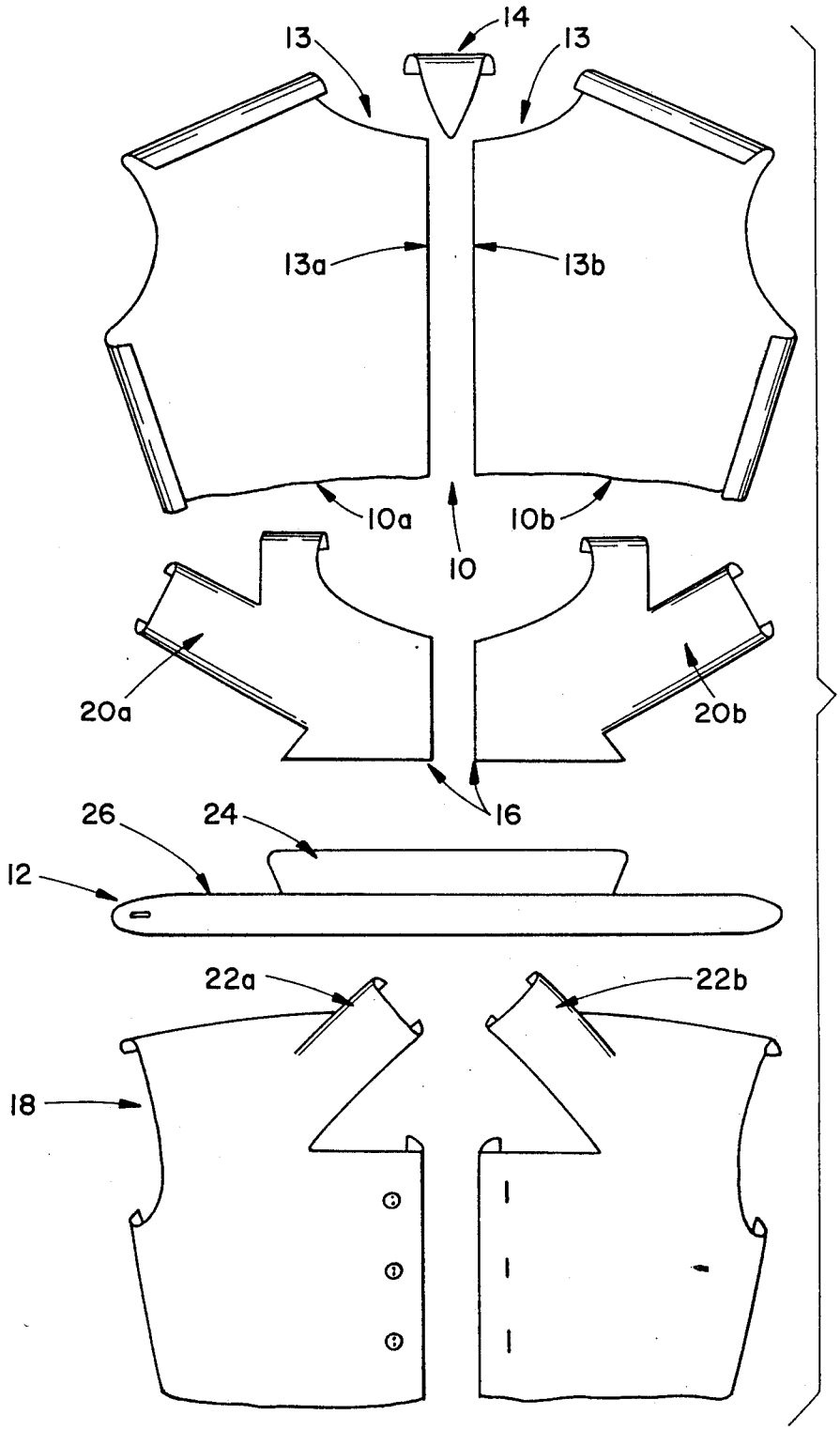
FIG. 1 is an exploded view of the individual basic pieces of the shirt body and two-part shirt collar in accordance with the present invention.

Referring now to the drawings wherein the showings are for purposes of illustrating the preferred embodiment of the invention only and not for purposes of limiting same, FIG. 1 shows a two-part collar of the type secured to a shirt at the shirt's upper neck edge opening includes a back shirt section 10 divided into two portions 10*a* and 10*b*. A back collar section 12 is attached to the back shirt section 10 at the back shirt section's upper neck opening 13 at the bottom edge of back collar band 26. Next, sections 10*a* and 10*b* are brought together and individually secured to the entire back shirt section 10 and thereafter attached together along lines 13*a* and 13*b*. Optionally, 10*a* and 10*b* may be attached together before the back collar is attached at the upper neck opening 13.

The connection between the back collar 12 and the back shirt section 10 is reinforced by the application of a V-shaped-type reinforcing material 14 which is placed with its wide section centered between the two portions 10*a* and 10*b* of the back shirt section 10, and with its wide section at the upper neck shirt opening. The V-type reinforcing material 14 is then sewn to the shirt.

The front shirt section 18 is also in two portions as is the front collar section 16. Unlike the back shirt section 10, however, the two portions of the front shirt section 18 are not sewn or permanently attached; rather, buttons disposed on the front shirt section will be used to secure the front shirt sections' two portions when required. The appropriate portion of the collar section 16 is sewn to the appropriate portion of the front shirt section 18.

The front shirt section 18 has a set of half flaps 22*a*, 22*b* and the front collar section 16 has a set of oppositely disposed, half flaps 20*a*, and 20*b*. To form flap 28*a* of FIG. 2, 22*a* is sewn to 20*a* with 22*a* being on the front or top surface and 20*a* being on the underside. The same procedure is followed in forming the half flaps 22*b* and 20*b* into flap 28*b* of FIG. 2.

It may be noted from FIG. 1 that half flaps 20*a*, 20*b*, 22*a*, and 22*b* are all integrally and permanently attached to the fabric of which they are associated. Specifically the half flaps are actually part of the pattern of the front shirt section 18 and the front collar section 16. Therefore, there is no need for securing or other attaching methods to secure the lower portion of the flaps 28*a* and 28*b* to the shirt.

The front shirt section 18 which has connected to it the front collar section 16 along with the two formed flaps 28*a* and 28*b* are then attached to the back shirt section 10 which, in turn, has the attached back collar 12 and the V-type reinforcing piece 14. The attachment of these two pieces forms the shirt body as can be seen in FIG. 2.

Turning to FIG. 3, it is shown that movement of the back collar's fold-down section 24 shown in an up position in FIG. 3 is independent from the front collar flaps 28.

As is illustrated in FIG. 4, the back collar fold-down section 24, when turned down, is at least partially covered by the front collar flaps 28 when the front collar flaps 28 are attached in a secured position. Such secured position is achieved in the preferred embodiment by the use of a snap-type arrangement wherein, as shown in FIG. 7, the flap 28*a* has one element of a snap 40 on the inner surface of the flap. With reference to FIG. 4, the second element of the snap 31*a* is located on the inner side of the back collar surface similar to that shown by 31*b*. Flap 28*a* is brought up and looped around a portion of the back collar 12, which includes a part of the fold-down section 24 of the back collar 12. The snap element 40 found on the flap 28*a* is then snapped into the receiving snap element 31*a* located on the inner side of the back collar band 26 of the back collar 12.

It may be noted that this is only one manner in which to secure the flaps 28*a* and 28*b*. Other methods of securing the flaps, such as a button-type arrangement or the use of Velcro, also work and such variations are included in this invention.

The back collar arrangement also includes a typical button-type arrangement wherein the back collar 12 includes an eyelet 34 and a button 32 to secure the collar in a closed position.

The back collar 12 is composed of several individual parts as shown in FIG. 5 including; a first back collar band 26*a*; a second back collar band 26*b*; a back collar stay 36; and back collar fold down section 24 previously described in FIGS. 3 and 4. The fold down section 24 and stay 36 are placed between the first back collar band 26*a* and second back collar band 26*b* after which the entire arrangement is sewn together producing a back collar 12 as shown in FIG. 6. When sewing the first back collar band 26*a* to the second back collar band 26*b*, it is important to align the collar bands to maintain the opening of the eyelets 34*a* and 34*b*.

The snaps 31*a* and 31*b* shown previously in FIG. 4 may at this time be attached to the inner surface of the second back collar band 26*b*. In FIG. 6, the second back collar band 26*b* will be completely attached to the first back collar band 26*a* such that both bands move as one.

The back collar stay 36 creates a degree of rigidity in the back collar 12 such that it assists in maintaining the back fold-down section 24 in the desired position, that desired position being either in an up position or in a fold-down position.

FIG. 7 again shows the independence of movement between the back collar 12, specifically the fold-down section 24 and the flaps 28*a* and 28*b*. FIG. 7 also illustrates the overlap between the fold down section 24 and flaps 28*a* and 28*b*.

The invention has been described with reference to the preferred embodiment. Obviously, modifications and alterations will occur to others upon reading and understand the preceding detailed description of the preferred embodiment. It is intended that the invention be construed as including all such modifications and alterations insofar as they come within the scope of the appended claims or the equivalents thereof.

What is claimed is:

1. A shirt having an improved collar construction comprising:
   - a back collar section;
   - a back shirt section joined to said back collar section;
   - a "V" type reinforcing means for reinforcing the joining of said back collar section and said back shirt section;
   - a front collar section;
   - a front shirt section joined to said front collar section;
   - a plurality of half flaps each integrally and permanently connected to said front shirt section and said front collar section;
   - a plurality of flaps formed through the connection of said front shirt section half flaps and said front collar section half flaps;
   - a connecting means for connecting said front shirt section and said back shirt section; and,
   - a holding means for holding said plurality of flaps in a selected position which covers at least a portion of said back collar section and where said holding means is adapted to hold said flaps at an area located on the interior of said back collar section.

2. The two-part collar as recited in claim 1, wherein one part of said two-part collar is said back collar section and the other part of said two-part collar includes said plurality of flaps and, further, wherein both parts of said two-part collar act independent of each other part.

3. The two-part collar as recited in claim 1, in which said back collar section comprises;

first and second back collar bands joined together and each having an eyelet disposed at at least one end;

a back collar stay and a back collar fold-down section positioned between said first and second back collar bands.

4. The two-part collar as recited in claim 3, wherein said first and second back collar bands are joined together such that said first and second back collar bands' individual eyelets are arranged to allow a button to pass through the combined first and second back collar band's combined eyelet.

5. The two-part collar as recited in claim 1, wherein said flaps are formed such that said front shirt section's half flaps are on the outer side and said front collar section's half flaps are on the bottom side when said flap is appropriately secured.

6. The two-part collar as recited in claim 5, wherein said flaps are two oppositely disposed flaps located on said front shirt section adapted to loop around at least a part of said back collar section and to attach in a secured position on the inside of the shirt.

7. The two-part collar as recited in claim 6, wherein said flaps may be secured using a snap or button-type arrangement, wherein one element of said snap or button arrangement is located on said flap and the other element is located on said back collar section.

8. A collar as recited in claim 7, wherein the lower portion of said flaps are integrally and permanently connected to said front shirt section and front collar section such that the lower portion of said flaps remain in a fixed position.

9. A method of manufacturing a shirt having an improved collar comprising the steps of:

combining a back shirt section and a back collar;

reinforcing the combination of said back shirt section and said back collar through the use of a "V" type reinforcing section;

connecting a front shirt section and a front collar;

forming a plurality of flaps, wherein said flaps are formed from the combination of material of said front shirt section and said front collar;

joining said front shirt section and said back shirt section, wherein such joining allows for independent movement of said flaps and said back collar;

adjusting said flaps, such that at least a portion of said flaps cover said back collar; and, securing said flaps to a portion of said back collar, thereby restructuring the movement of said flaps.

* * * * *